US006419503B1

(12) United States Patent
Choy

(10) Patent No.: US 6,419,503 B1
(45) Date of Patent: Jul. 16, 2002

(54) ALIGNMENT DEVICE FOR USE WITH CONNECTOR

(75) Inventor: Edmond Choy, Union City, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/849,814

(22) Filed: May 4, 2001

(51) Int. Cl.[7] ..... H01R 12/20
(52) U.S. Cl. ..... 439/79
(58) Field of Search ..... 439/79, 381, 325–328, 439/160, 159

(56) References Cited

U.S. PATENT DOCUMENTS 5,468,154 A * 11/1995 Yip et al. ..... 439/79
5,540,598 A * 7/1996 Davis ..... 439/79
5,591,036 A * 1/1997 Doi et al. ..... 439/79
6,077,092 A * 6/2000 Chiu et al. ..... 439/79
6,116,917 A * 9/2000 Choy ..... 439/79

* cited by examiner

*Primary Examiner*—Gary Paumen
(74) *Attorney, Agent, or Firm*—Wei Te Chung

(57) ABSTRACT

A card edge connector comprises an insulative housing defining a central slot with a plurality of contacts by two sides. The contacts define plural rows of contact tails extending downwardly around the rear portion of the housing. A pair of ejectors are positioned at two opposite ends of the housing. A plurality of partitions are formed on the rear face of the housing with slots formed between every adjacent two partitions. A spacer is assembled to the connector. The spacer cooperates with the partitions to align all the contact tails of the connector.

1 Claim, 11 Drawing Sheets

10
12
14
20
24
26
30
40

36
34
10
20
24
40
30
20
26

ALIGNMENT DEVICE FOR USE WITH CONNECTOR

BACKGROUND OF THE INVENTION

1. Field of the Invention

The invention relates to electrical connectors, and particularly to the card edge connector with the spacer for aligning the contact tails of connector.

2. The Related Art

U.S. Pat. No. 6,116,917 (the '917 patent) having the same applicant and the same assignee with the invention, discloses the slanted type DIMM (Dual In-line Memory Module) card edge connector with the spacer thereof for alignment of the contact tails extending downwardly on a rear portion of the connector. Even though most of time, the spacer shown in the '917 patent and disclosing alignment of the two outmost rows of contact tails, is sufficiently practical to be utilized in most applications, under some specific situations there is still desirability to have all the contact tails precisely aligned in position with regard to the connector so that the whole connector can be correctly mounted on the printed circuitboard. This requirement is especially recommended if the contact tails are longer than the spec defined by the standard and tend to be deflected.

It is also noted that different from the traditional right angle type contact tails sharing the relative larger space on the rear portion of the horizontal type connector, the slanted type connector has less space around the rear portion thereof. Also, because of miniaturization requirement, the contact tails group are required to be disposed as close to the base of the housing as possible. The traditional single spacer for aligning all the contact tails around the rear portion of the housing may not be fit for the slanted type connector. Thus, provision of a simple while effective structure for alignment of all the contact tail in a slanted type connector, is desired.

Therefore, an object of the invention is to provide means in the connector for aligning all the contact tails around the rear portion of the housing.

SUMMARY OF THE INVENTION

According to an aspect of the invention, a slanted card edge connector comprises an insulative housing defining a central slot therein for receiving a card module therein. A plurality of contacts are disposed by two sides of the central slot for electrical engagement with inserted card module. A pair of ejectors are positioned at two opposite ends of the housing for locking/ejecting the card module. Plural rows of contact tails of the contacts are disposed about a rear portion of the housing wherein all the rows of contact tails except those of the innermost row, are aligned by a spacer, and the contact tails in the innermost row are retained in the corresponding slots, which are formed by a plurality of partitions extending rearwardly from the rear face of the base around the rear portion of the housing. The spacer optimally includes further a plurality of embossments extending from a rear edge thereof and toward the corresponding slots for abutment against the corresponding contact tails in the innermost row, respectively. Thus, each of the contact tails in the innermost row can be properly confined in position in the corresponding slot by means of the corresponding embossment and the opposite abutment section, and the two opposite partitions. Therefore, the spacer with the partitions may correspondingly align all the contact tails of the connector.

DETAILED DESCRIPTION OF THE PREFERRED EMBODIMENTS

Figure 1:
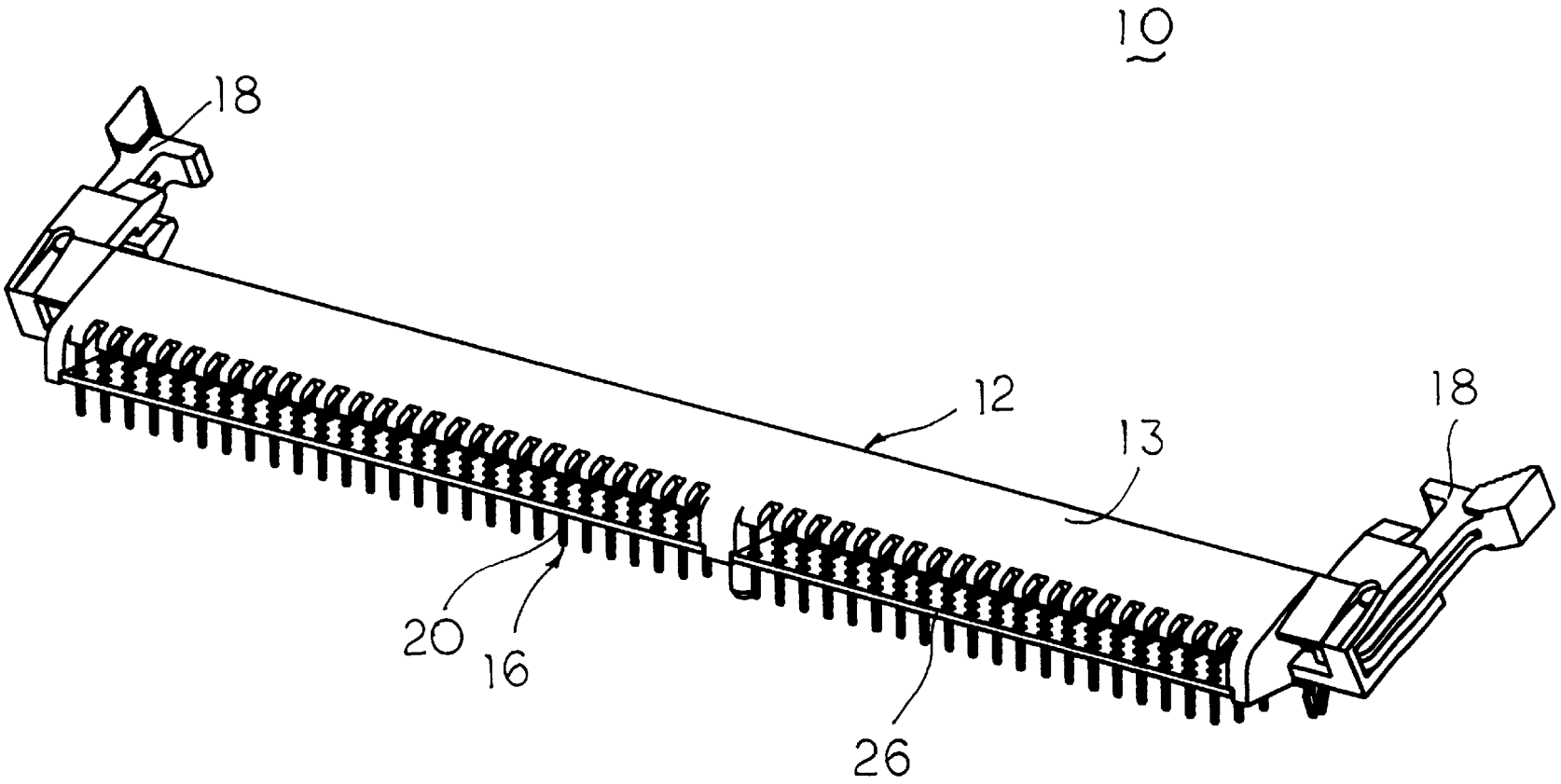
FIG. 1 is a top perspective view of an embodiment of the slanted card edge connector with the spacer thereof, according to the invention.
Figure 2:
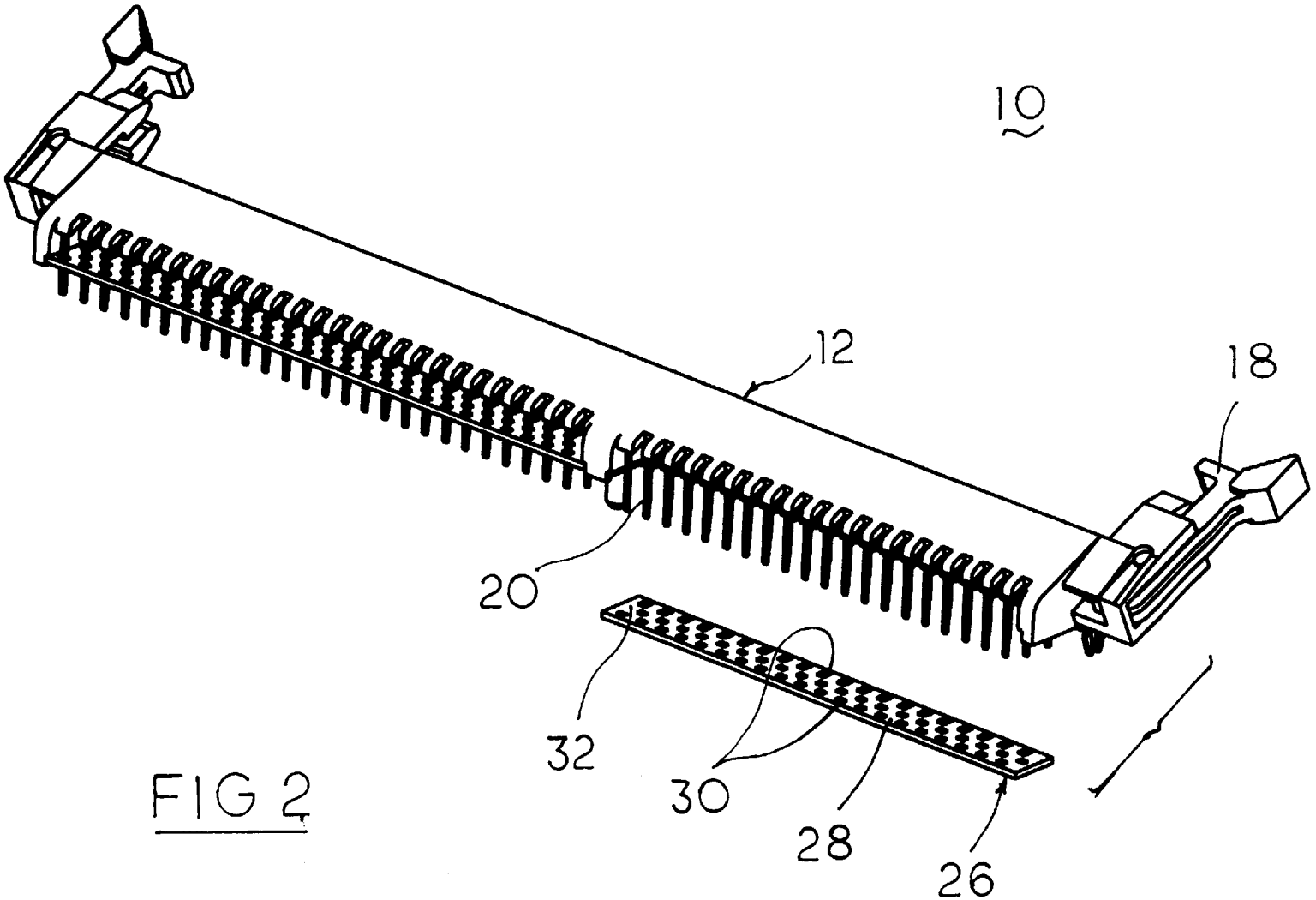
FIG. 2 is an exploded perspective view of the connector of FIG. 1 with one spacer is disassembled therefrom.
Figure 3:
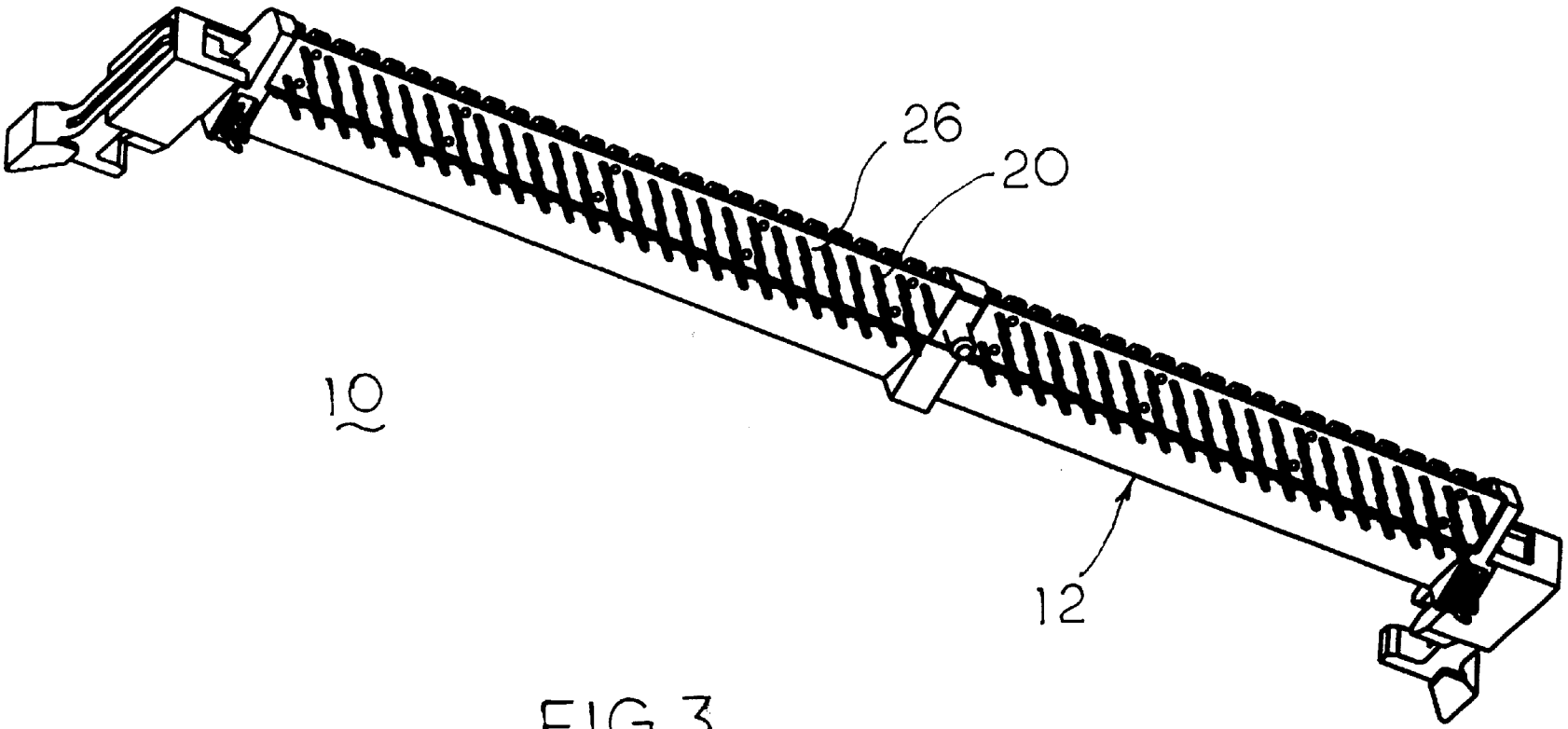
FIG. 3 is a bottom perspective view of the connector of FIG. 1.
Figure 4:
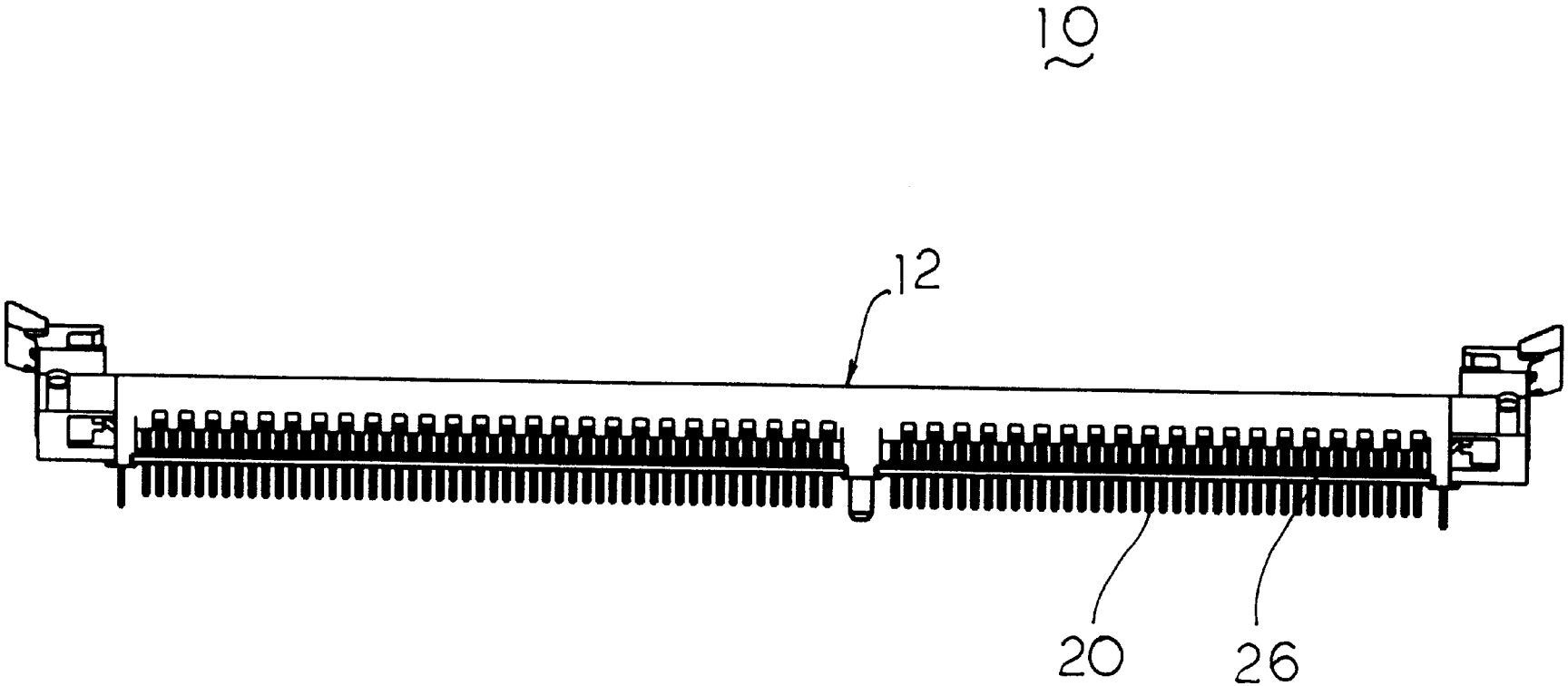
FIG. 4 is a front elevational view of the connector of FIG. 1.
Figure 5:
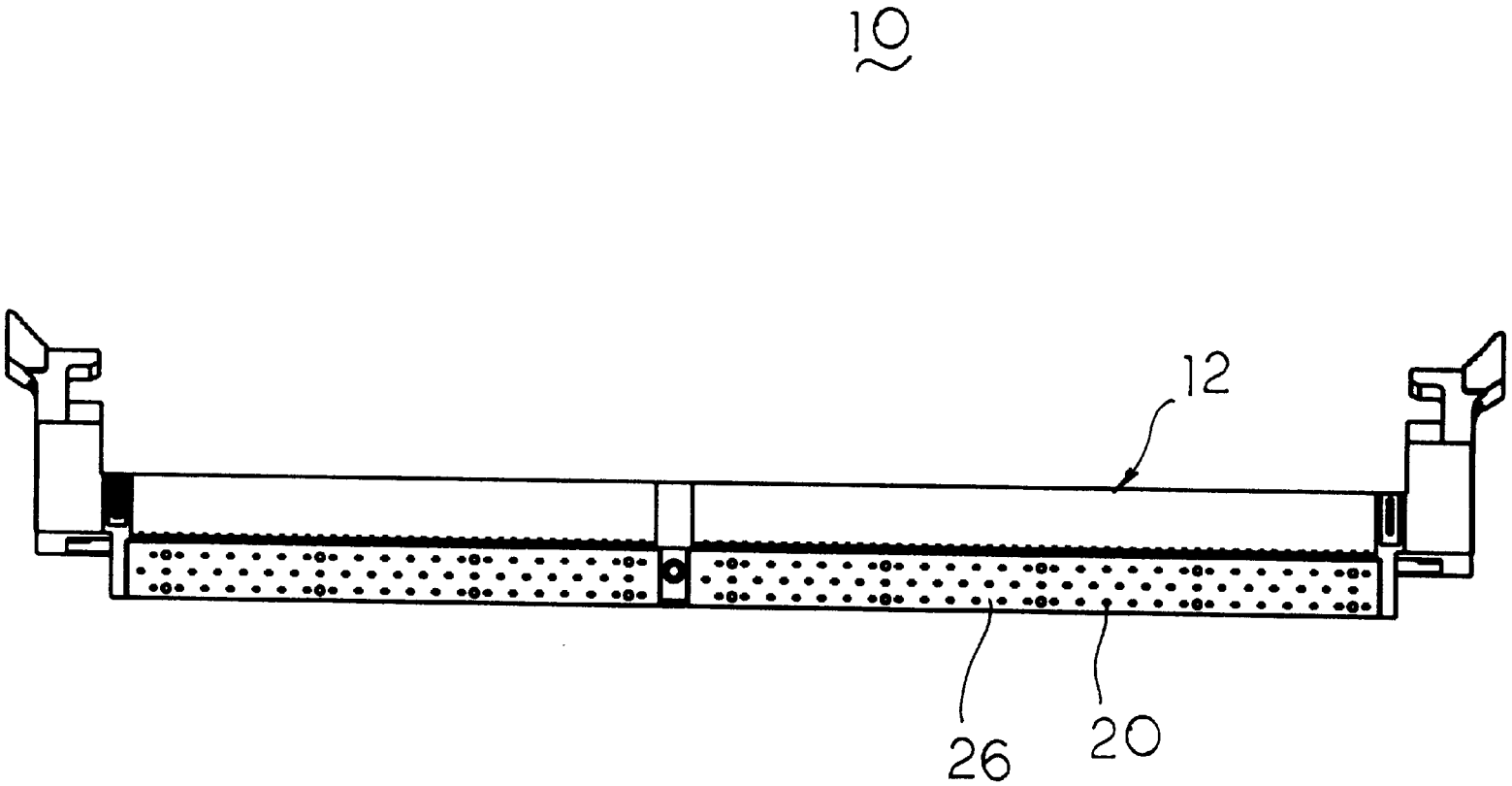
FIG. 5 is a bottom view of the connector of FIG. 1.
Figure 6:
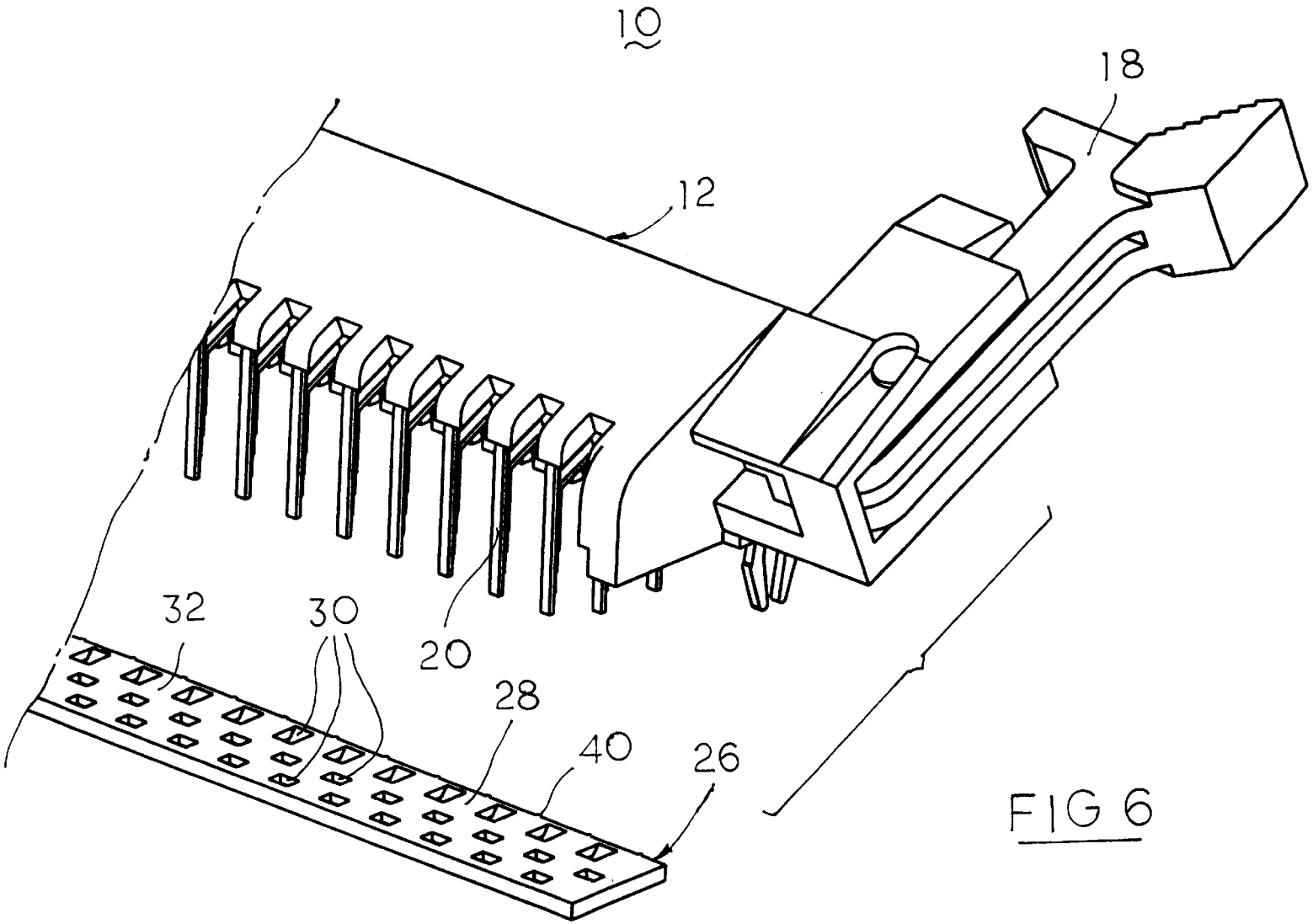
FIG. 6 is an enlarged partial top perspective view of the connector of FIG. 2 with a disassembled spacer thereof.
Figure 7:
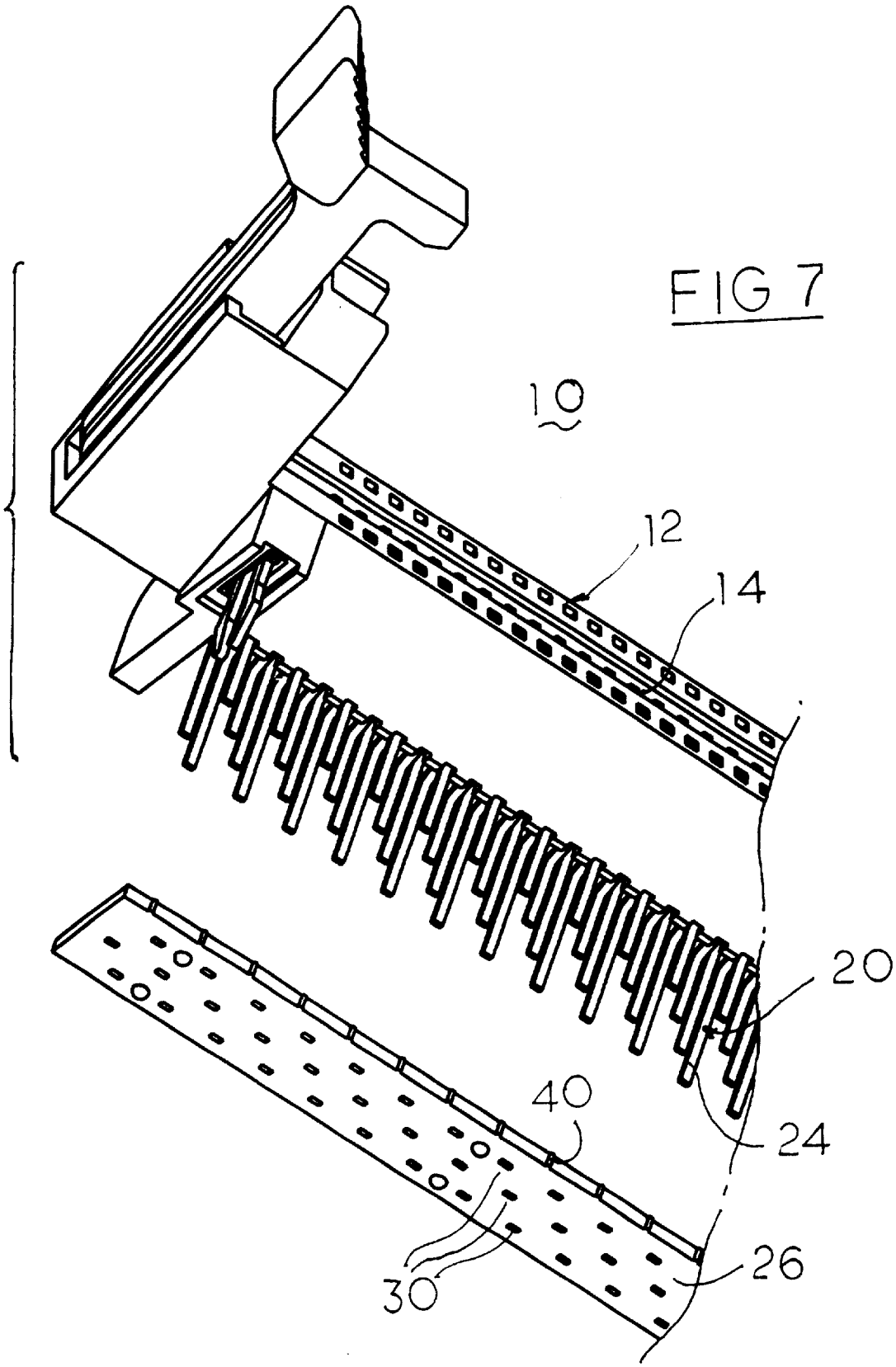
FIG. 7 is an enlarged partial bottom perspective view of the connector of FIG. 2 with a disassembled spacer thereof
Figure 8:
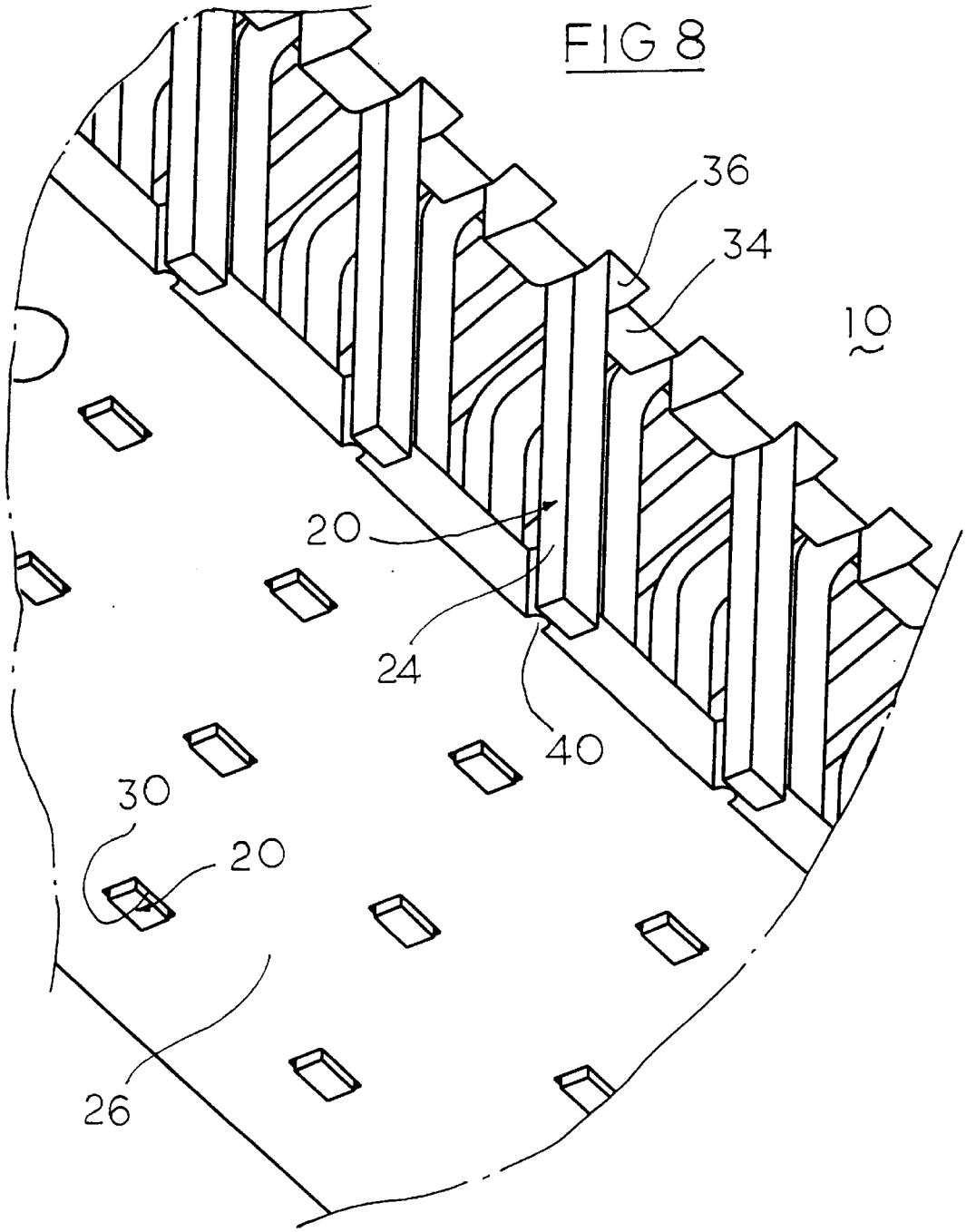
FIG. 8 is a greatly enlarged partial bottom perspective view of the connector of FIG. 1 with the spacer just initially contacting the contact tails before reaching its final position.
Figure 9:
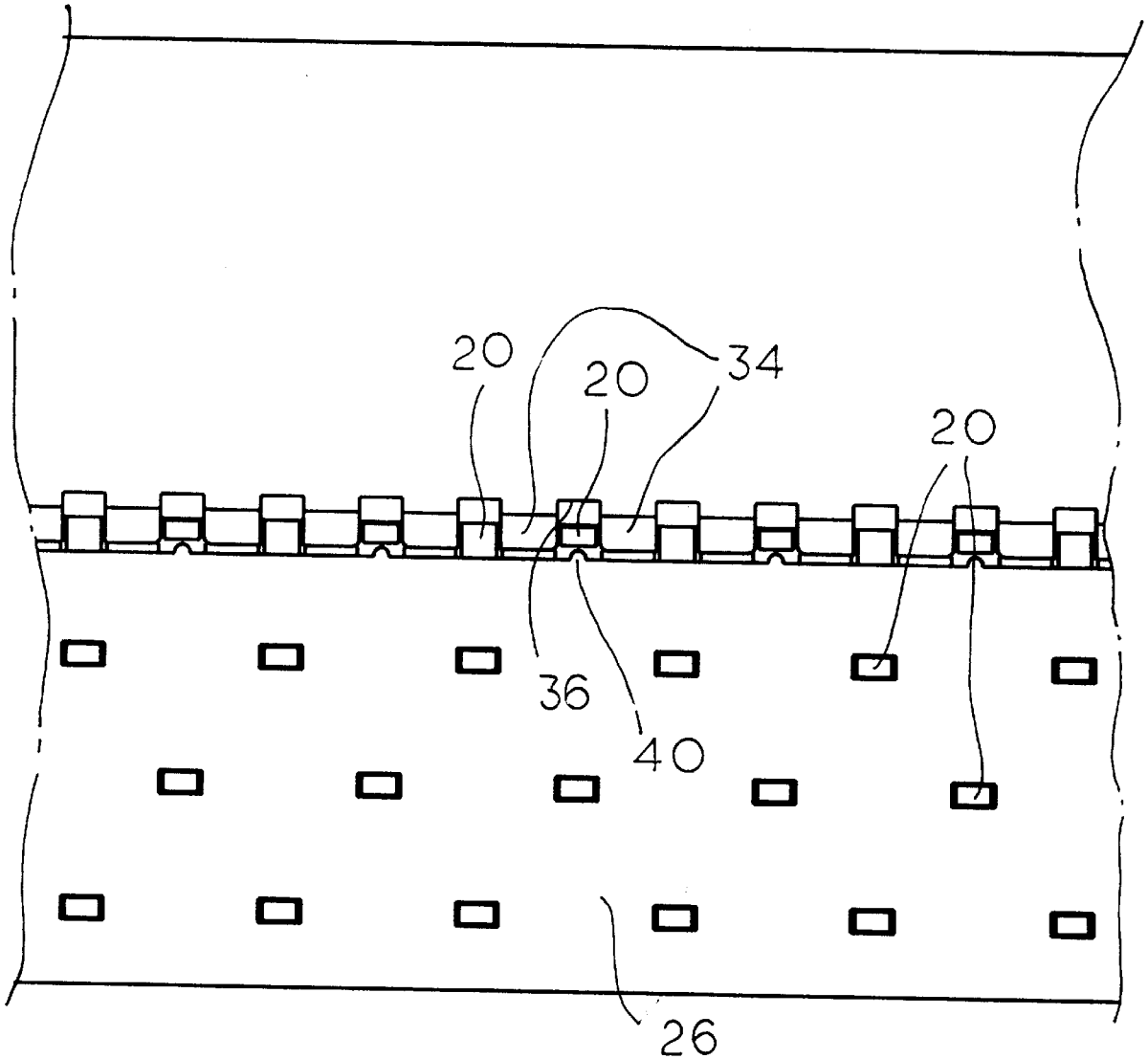
FIG. 9 is a greatly enlarged partial bottom view of the connector of FIG. 1.
Figure 10:
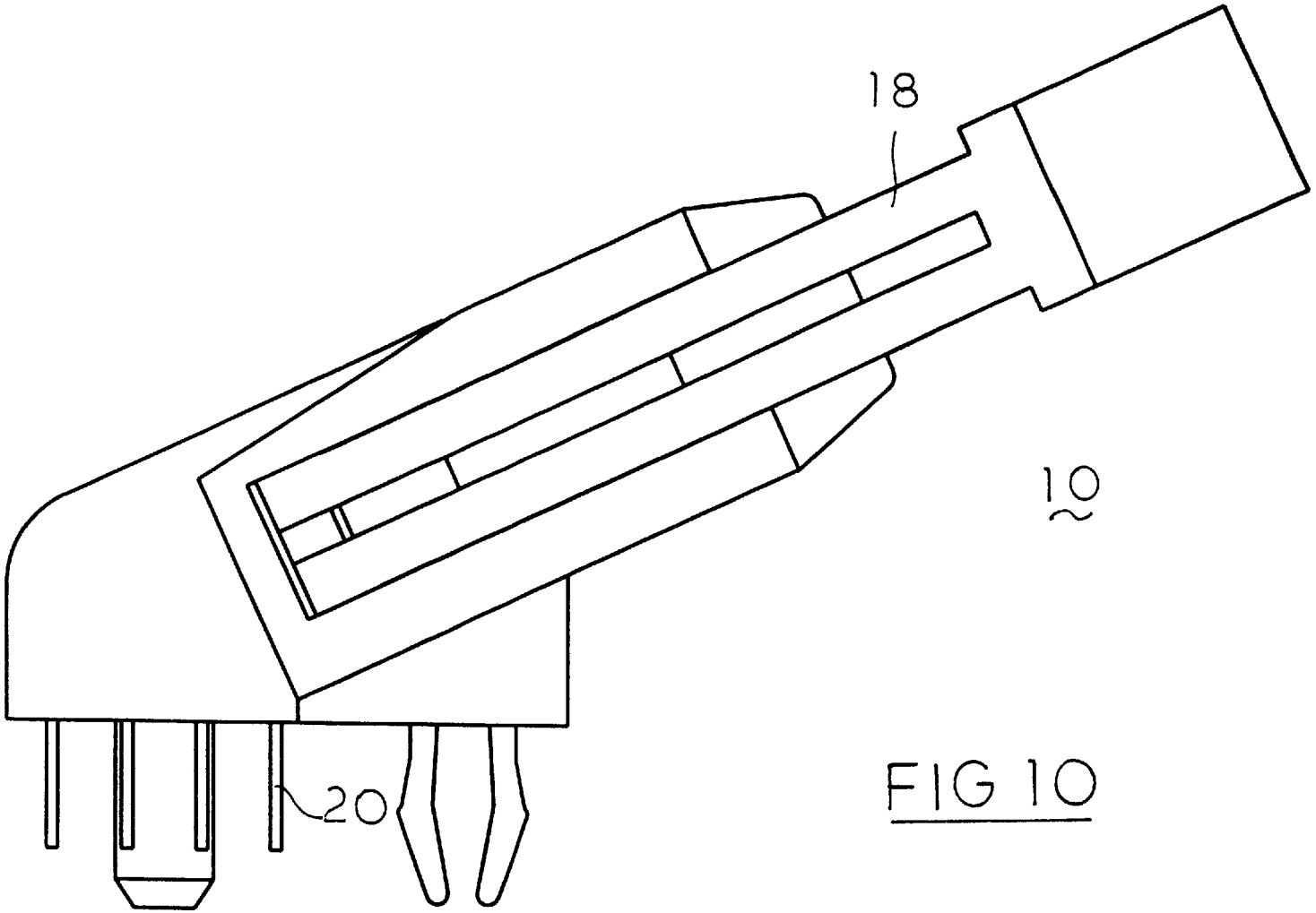
FIG. 10 is a side elevational view of the connector of FIG. 1.

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Attention is directed to FIGS. 1–11 wherein a slanted card edge connector 10 includes an insulative housing 12. The housing 12 includes a base 13 defining a central slot 14 therein with a plurality of contacts 16 by two sides of the central slot 14. A pair of ejectors 18 are positioned at two opposite ends of the housing 12.

Figure 11:
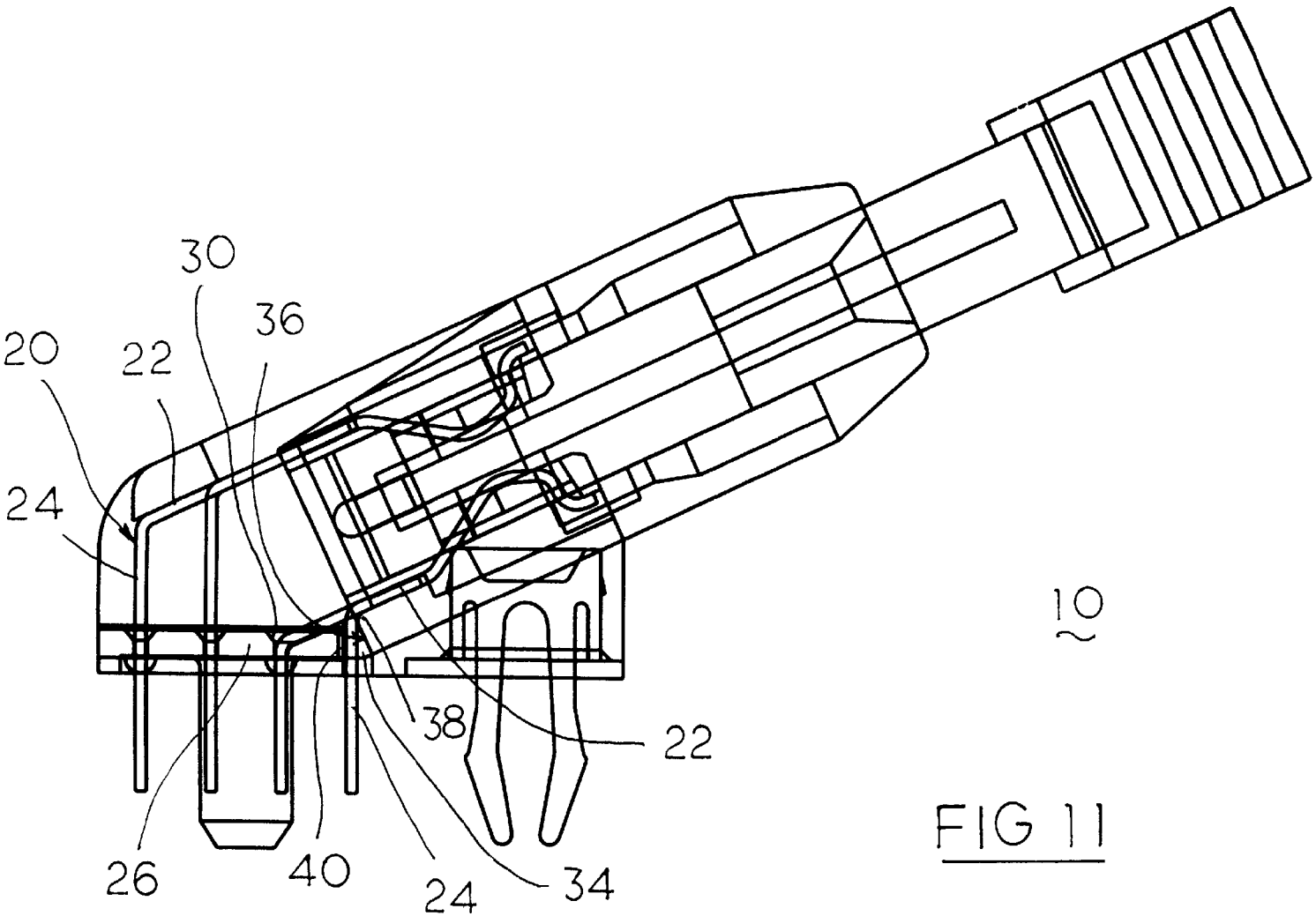
FIG. 11 is a side elevational view of the connector of FIG. 1 with unhidden lines thereof for illustrating how the embossment of the spacer engages the corresponding contact tails and how the contact tail is received within the slot between two adjacent partitions.

Each contact 16 includes a contact tail 20 extending out of the rear face of the base 13 with an oblique section 22 and a vertical section 24 thereof (FIG. 11). The vertical sections 24 of the contacts 16 are arranged in four rows. Two spacers 26 are provided around the rear portion of the housing 12 for aligning the vertical sections 24 of the contact tails 20. Each spacer 26 includes a plate-like main body 28 with three rows of holes 30 therein.

The three rows of holes 30 receive the corresponding vertical sections 24 of the contact tails 20 in the three outer rows, respectively, wherein the holes 30 in the innermost row of the spacer 26 have relatively larger guidance openings in the upper face 32 thereof than those in other two rows. It is because the corresponding contact tails 20 received in the holes of the innermost row have the relatively lower profile oblique sections 22 and such larger guidance openings may tolerate such lower profile.

To efficiently align the vertical section 24 of the contact tail 20 in the innermost row, a plurality of triangle-like partitions 34 extend downwardly from a rear face of the base 13 with a plurality of slots 36 formed between every adjacent two partitions 34. The vertical section 24 of the contact tail 20 in the innermost row abuts against the abutment section 38 around the rear face (FIG. 11) and is received within the corresponding slot 36. Oppositely, a plurality of embossments 40 are formed on the rear edge of the spacer 26 correspondingly for abutting against the corresponding vertical sections 24 of the contact tails 20 in the innermost row so that such a vertical section 24 is sandwiched between the embossment 40 and the abutment section 38 in a front-to-back direction, and restrained by the two side partitions 34 in a left-to-right direction, thus resulting in good alignment.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included in the scope of the following claims.

I claim:

1. A slanted electrical connector, comprising:

an insulative housing with a plurality of partitions formed on a rear face thereof, a slot being formed between every adjacent two partitions;

a plurality of contacts positioned in the housing with plural rows of contact tails downwardly extending around a rear portion of the housing; and plate-like spacers provided around the rear portion and defining plural rows of through holes; wherein all the contact tails except those in an innermost row thereof, extend through the corresponding holes while those in the innermost row are received in the corresponding slots;

wherein the contact tails in the innermost row abut against the spacers for restricting movement in a front-to-back direction;

wherein a plurality of embossments are formed on a rear edge of each spacer corresponding to the slots, and abut against the corresponding contact tails in the slots, respectively;

wherein the partitions are of a triangular configuration;

wherein the through holes in a inner most row oft he spacers have relatively larger guidance openings in an upper face thereof.

* * * * *